United States Patent [19]

Tobin, Jr.

[11] 4,292,262

[45] Sep. 29, 1981

[54] CERAMIC MATERIAL PROCESSING

[76] Inventor: Leo W. Tobin, Jr., Morehouse La., Darien, Conn. 06820

[21] Appl. No.: 52,874

[22] Filed: Jun. 28, 1979

[51] Int. Cl.[3] ..... B28B 1/26

[52] U.S. Cl. ..... 264/26; 264/86

[58] Field of Search ..... 264/22, 25, 27, 23, 264/86, 26

[56] References Cited

U.S. PATENT DOCUMENTS

| | | | |
|---|---|---|---|
| 3,585,258 | 6/1971 | Levinson | 264/25 |
| 3,673,288 | 6/1972 | Childs | 264/25 |
| 3,732,048 | 5/1973 | Guerga et al. | 264/25 |
| 3,935,060 | 1/1976 | Blome et al. | 264/25 |
| 4,126,651 | 11/1978 | Valentine | 264/25 |
| 4,150,514 | 4/1979 | Douglass | 264/25 |
| 4,163,140 | 7/1979 | Bardet | 264/25 |

*Primary Examiner*—John Parrish

*Attorney, Agent, or Firm*—Sprung, Felfe, Horn, Lynch & Kramer

[57] ABSTRACT

An illustrative embodiment of the invention provides a technique for applying the deep heat capabilities of microwave energy to the problems of ceramic ware production. A plaster-of-paris mold, filled with "slip" is exposed to microwave energy to produce a "green body" in a few minutes. After excess "slip" is decanted and the "green body" is exposed, the mold is dried through microwave heating, weighed and then brought up to the proper degree of moisture by spraying and weighting. The "green body", moreover, after finishing is further dried through microwave heating.

3 Claims, 1 Drawing Figure

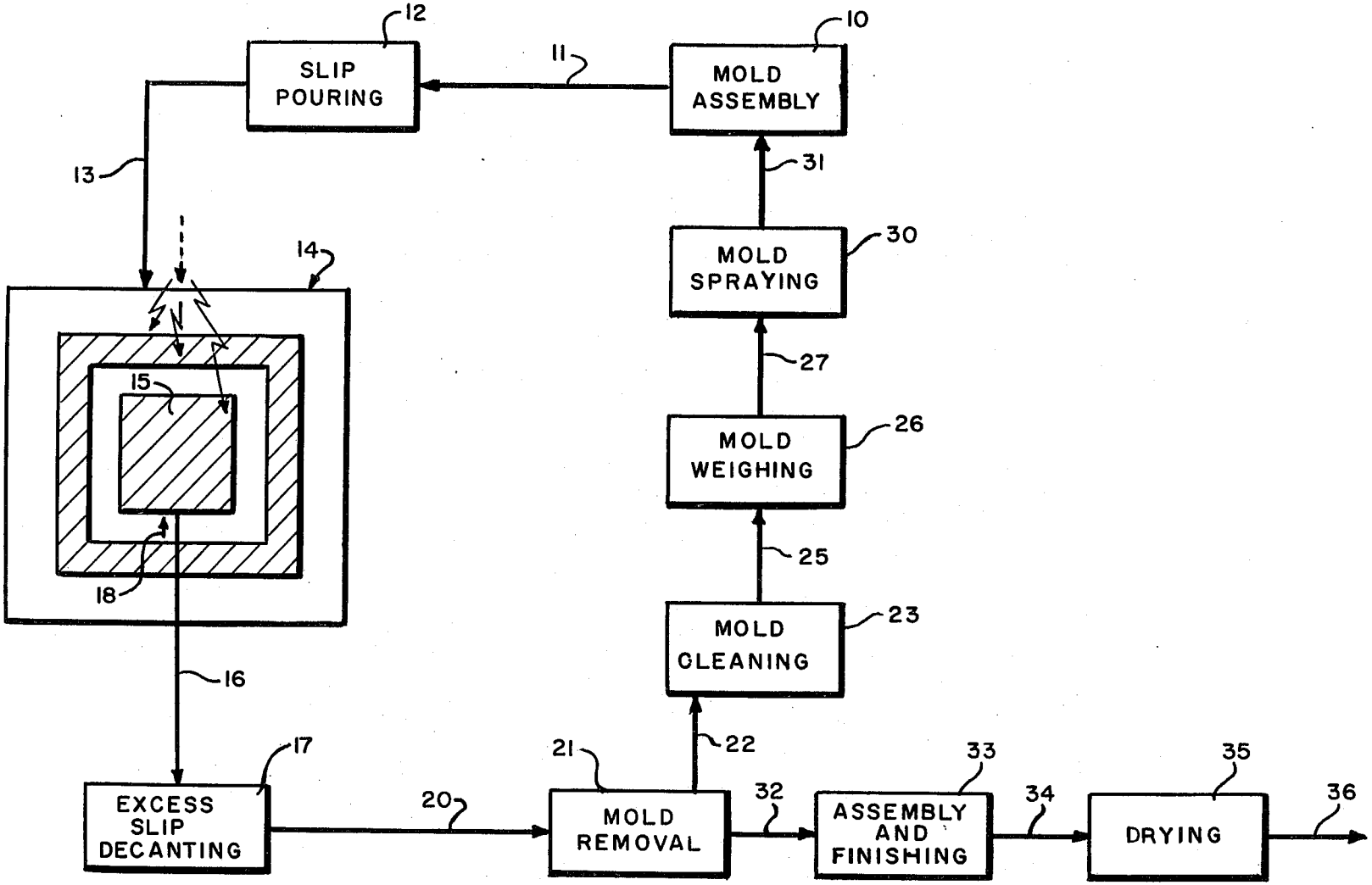
MOLD ASSEMBLY
MOLD SPRAYING
MOLD WEIGHING
MOLD CLEANING
ASSEMBLY AND FINISHING
DRYING
SLIP POURING
MOLD REMOVAL
EXCESS SLIP DECANTING
10
11
12
13
14
15
16
17
18
20
21
22
23
25
26
27
30
31
32
33
34
35
36

CERAMIC MATERIAL PROCESSING

This invention relates to ceramic material processes and, more particularly, to an improved technique for accelerating the casting process and for controlling moisture in the molds for the manufacture of ceramic ware, and the like.

The manufacture of ceramic products is a very important field of industrial activity. Building supplies, plumbing fixtures and chinaware are only illustrative of the many different product lines that rely on ceramic production methods.

As a general matter, there are a number of ways in which ceramic products can be produced. One of these established techniques relies upon using "slip" and a plaster-of-paris mold. "Slip" which may be, for example, a free-flowing liquid mixture of ball clay, china clay, silica sand, nephelin cyanite and water, is poured into the mold. The mold absorbs some of the water from the "slip", causing solid matter in the "slip" to form a clay cake on the mold surface that exhibits the proper molded shape. The volume of liquid "slip" remaining in the mold after it has been "set up" in the foregoing manner is drained from the mold and the mold then is removed to leave free-standing the solid matter, or "green body".

The "green body" is cleaned, finished and dried before it is glazed and fired in a kiln to form the finished ceramic product.

After the mold is removed from the "green body", the mold is dried to expel the water that it absorbed from the "slip", thereby making the mold available for further use. Clearly, if the absorbed water is not expelled from the mold, the mold will not produce a satisfactory "green body" when it is used again because of its decreased capacity to absorb water from the second charge of "slip".

In spite of the fact that this method of producing ceramic articles is well developed and has been commercially successful for a long time, it is, nevertheless, desirable to seek further process improvements. Illustratively, the time required for the water in the "slip" to invade the mold in order to produce a "green body" of suitable thickness can take several hours. Naturally, process times of this length are not entirely satisfactory from a number of viewpoints. These intervals impose a need to maintain a large inventory of molds and other associated equipment as well as requiring a great deal of plant floor space for a given production volume. Further in this respect, the overall effect of this time requirement is to create a "batch" process for ceramic ware production in contrast to a more economically desirable and efficient linear, or continuous process.

After use, the mold presents another very difficult production problem. As mentioned above, the water that is absorbed in the mold from the charge of "slip" must be expelled to enable the mold to be used once more. Ordinarily, these molds are dried in specially controlled atmosphere rooms or buildings during a period of up to sixteen hours. This procedure is quite cumbersome in that it reduces mold utilization to one working shift in every twenty-four hours and expends a considerable amount of energy in the drying process.

There are, moreover, several additional and more subtle disadvantages in this procedure. The degree to which water has been expelled from a particular mold, and the suitability of this mold for producing another "green body" are questions that are best answered through the judgment of experienced personnel rather than through a system of measuring instruments, or the like. Even under the most optimum circumstances, the production yield of green bodies is limited by the moisture content problem to about 75 percent. This use of skilled personnel, however, is not only expensive, but also has led to unsatisfactory mold-moisture control and an unfavorable quality assurance experience that limits the process to one shift.

Beyond "green body" production, there is the further need to dry the "green body" and produce a finished product with a suitable glaze. Kilns or gas-fired ovens ordinarily are used in this last portion of the process. Once more, the time required to complete drying and glazing in a kiln or oven makes the process a "batch" process as well as consuming a great deal of natural gas for heating purposes.

Accordingly, although current processes for manufacturing ceramic ware are successful and produce acceptable products, there remain continuing needs not only to reduce production time and mold inventory but also to improve product quality, productivity, and production yield. Beyond satisfying these needs, there is the further goal of developing a linear or continuous ceramic ware process, in contrast to the "batch" processes that characterized the heretofore existing technology.

To a great extent, these objects are achieved through the practice of the invention which, in very broad terms, adapts microwave heating technique to the needs of the ceramic ware industry.

Illustratively, it has been discovered that the deep uniform heating properties of microwave energy removes water from slip, clay and plaster-of-paris molds with surprising rapidity and with impressive efficiency. A three- to four-minute microwave exposure at approximately 750 watts is sufficient with a set time of about twenty minutes, for example, to produce a "green body" with the same green strength and mechanical stability as a body produced in one hour to two hours in the conventional manner of the prior art.

Perhaps more important is the fact that microwave application to ware production decouples the process from the plant atmosphere by rapidly expelling water from plaster molds to a degree of dryness that enables these molds to be ready for use within a "green body" set-up cycle. Thus, it has been found that wet plaster couples to microwave energy much more efficiently than dry plaster, thereby enabling the moisture-removing heat to be preferentially generated in the wet portions of the mold. This phenomenon further decreases not only the mold drying time but also reduces the energy requirements for this portion of the process.

Mold drying in this manner is so efficient that after microwave application the individual molds are, in accordance with a specific feature of the invention, weighed and subjected to a water spray in order to achieve a proper degree of wetness. In these circumstances the entire matter of mold preparation is removed from a dependency upon the personal judgement of a skilled technician with attendant quality assurance problems, and placed on an analytical basis that is independent of personal judgment. "Green body" production yields are markedly improved.

The process of drying the clay body also benefits from the use of microwaves in ceramic ware production. Typically, in accordance with the invention, "green bodies" are dried through an application of microwave energy to provide acceptable items of ceramic ware.

Because microwave heating so reduces the times that are required to accomplish each portion of the ceramic ware production process, the entire technique now can be viewed as a continuous or linear process, in contrast with the batch processes that have been so distinctive of the prior art. Mechanical conveyors, for instance, can be combined with microwave ovens and processing ware manipulating apparatus to provide an almost continuous production of ware pieces. Thus, molds can be automatically filled with "slip", placed on a rail conveyor and run into a microwave oven to provide a more rapid setup in forming a suitable "green body". After about four minutes the molds are withdrawn from the oven and are allowed to set for about twenty minutes on the conveyor. The liquid "slip" then is poured from the molds and the molds are immediately opened to permit the "green bodies" to be removed.

At this point in the procedure, the molds have been dried as a consequence of the microwave process during the set up time in the oven. The molds then are weighed to determine actual moisture content and moistened to adjust the weight to that required for proper casting if necessary, in order to make the molds so treated immediately available for another "slip" pouring. Not only is the mold inventory for a given ware production level reduced markedly, but three-shift operation with the same molds becomes possible and plant or drying room atmosphere control is no longer required.

As a further development, the process is "balanced" in that the mold, mold and "green body", or only the "green body", is coordinated with the conveyor mechanism and the dwell time that this mechanism establishes within a microwave oven to time the transfer of the material that is being processed to move at a steady, continuous pace through the oven or ovens. In these circumstances, the material emerging from the oven will have completed a particular phase of the heating or drying process as a part of a continuously moving production line.

These and other objects and advantages of the invention are described more completely when taken together with the drawing and the following detailed description of a number of preferred embodiments.

The sole FIGURE of the drawing is a schematic diagram of a process embodying principles of the invention.

As shown in the drawing, an illustrative embodiment of the invention involves an initial step of mold assembly at a mold assembly station 10. At the assembly station 10, permeable and suitably dry plaster-of-paris segments of a mold are fitted together to form a complete mold. One or more of these assembled molds are placed on a robot, or moving conveyor 11, for transport to a "slip" pouring station 12.

At the slip pouring station 12, the mold is filled and the combination mold and "slip" then are moved on a conveyor 13 to a microwave oven 14.

It has been found that a mold and slip combination 15, in a microwave test oven at an exposure of approximately 750 watts for about four minutes will, after setting for about twenty minutes followed by "slip" dump, produce a "green body" that has the same green strength and mechanical stability as a "green body" that is allowed to "set" for generally two hours in accordance with the prior art. Thus, the mold and slip combination 15 is moved out of the oven 14 on a conveyor 16 during an interval of about twenty minutes to an excess slip decanting station 17. At the decanting station 17, the liquid slip is drained from the mold.

The mold now encloses only a "green body". In this circumstance, the mold and "green body" both are moved from the slip decanting station 17 along a conveyor 20 to a mold removal station 21. At the mold removal station 21 the plaster-of-paris portions of the mold are separated from each other and from the "green body".

A series of tests were conducted to demonstrate the effectiveness of this portion of the invention, the production of satisfactory "green bodies". The test data is as follows:

| Test No. | | |
|---|---|---|
| 1 | Empty dry weight | 25¾# |
| | with strap wedge & plug | 26½# |
| | with Slip | 31½# |
| | | Avg temp |
| | 1.5 kW - 3 min. | 144° F. - no set |
| | Slip Drain | 710 ml |
| | 1.5 kW - 1½ min - | |
| | to Green Strength - to dry | |
| | Mold weight - empty | 26# |
| 2 | Weight | 26½# |
| | with Slip | 31½# |
| | 1.5 kW - 3 min. - 15 min. set | |
| | Drain | 500 ml |
| | 1.5 kW - 1 min. - Green Strength - | |
| | to dry | |
| 3 | Empty mold weight | 25.7# |
| | Filled | 31.6# |
| | 1.5 kW - 3.5 mm - 12 min. set | |
| | Drain | 550 ml |
| | 1.5 kW - 0.75 min. - Green Strength | |
| 4 | Empty weight | 26½# |
| | Full | 31½# |
| | 1.5 kW - 3.5 mm - 25 min. set | |
| | Drain | 450 ml |
| | Green Strength after drain | |
| | NEXT DAY - OVERNIGHT DRY OF MOLDS | |
| 5 | Weight full | 31½# |
| | 1.5 kW - 4 min. - 20 min set | |
| | Drain | 450 ml |
| | Green Strength | |
| 6 | Weight | 31½# |
| | 1.5 kW - 4 min - 24 min set | |
| | Drain | 340 ml |
| | Green Strength | |

Alternatively, the robot or the conveyor 13 can run several mold and "slip" combinations into the microwave oven 14 for a period of time. After this initial period, the conveyor 16 may withdraw the mold, mold surface cake and "slip" combination from the oven 14 in order to decant the excess "slip" at the "slip" decanting station 17. In accordance with this illustrative embodiment of the invention, however, the robot or conveyor 16 can then transfer the mold and mold cake combination back into another microwave oven 15 in the direction of arrow 18 for about twelve minutes of drying to enable the mold surface cake to set up to green strength. Naturally, the combination mold and "green body" are transferred to the mold removal station 21 for separation and further processing. The process selected may include variations of the two methods.

The now separated mold is sent by way of a conveyor 22 to a mold cleaning station 23. At the cleaning station 23, any bits of the "green body" that adhere to the surface of the mold are removed in order to prevent matter of this character from marring the appearance of subsequent articles produced in this mold.

The now dry mold segments are transferred by means of a conveyor 25 to a mold-weighing station 26 in order to determine the precise quantity of absorbed water that was expelled from the segments in the process by comparing with the tare weight. It will be recalled that, in accordance with a feature of the invention, microwave processes have been found to be extremely efficient in drying wet plaster-of-paris molds, in contrast with the prior art approach of exposing wet molds in a controlled atmosphere (i.e., humidity, velocity of air flow) for about sixteen hours between each successive use of the molds under consideration. For example, in practicing the invention, approximately three pounds of water is removed per hour per KW at an efficiency (depending on size of load—more load, more efficient) approaching 50 percent of line input power to the microwave oven. Thus, after microwave drying during "green body" setup, the mold segments are dried to such a degree that it actually is necessary to add water to these molds in order to bring them up to an acceptable level of dampness. In this respect, experience has shown that completely dry plaster-of-paris molds are not suitable for proper "green body" formation. Prior to the present invention, if it was judged that a mold was too dry, it had been the practice to soak the mold in water until experience indicated that a suitable degree of mold dampness had been achieved. All of these judgements and mold condition decisions that characterized the prior art, however, were based on experience and "feel". In spite of the skill exercised in these matters, it was, nevertheless, inescapable that erratic results were obtained.

Through the practice of the invention, these erratic results are largely eliminated. Thus, the actual degree of mold dryness is determined to a high degree of accuracy by weighing the mold at the station 26. A conveyor 27 draws the dry, weighed molds to a mold-spraying station 30 for moisture addition. At the spraying station 30, sufficient water is added to the mold under consideration as determined, for example, through the increase in mold weight, to attain the proper degree of dampness for acceptable "green body" set up. Clearly, the functions of the mold-weighing station 26 and the mold-spraying station 30 can be combined, depending on the desired production system organization.

Upon attaining a suitable degree of mold dampness, the now moistened mold is transported by means of a conveyor 31 to the mold assembly station 10, to enable the above-described process of "green body" production to begin anew. In this way, the sixteen-hour drying period and controlled atmosphere facilities that characterized the prior art are avoided and mold utilization on a three-shift-per-day basis is now a realistic achievement.

It will be recalled that the molds are separated into segments at the mold removal station 21 to segregate the mold from the "green body". "Green bodies" exposed in the foregoing manner are drawn on a conveyor 32 to an assembly and finishing station 33 and ultimately, by means of a conveyor 34, to a drying station 35. The drying function at the station 35 also can be accomplished through microwave heating processes and a number of tests were conducted to prove the principles of this feature of the invention. During these tests a Raytheon QMP 1785 Radarline Batch oven and a Raytheon QMP 1879 microwave oven were used to dry "green body" toilet bowls.

In tests where single bowls are dried, the strong, first order, effect was rate of energy application, most easily expressed as kilowatts/bowl (kW/bowl). The tests were performed using power levels from 1 to 3 kW/bowl. The energy required varied from 3.75 to 4.25 Kwhr/bowl depending upon initial moisture content. Continuing exposure of a dried bowl to microwave energy produced no deleterious effects. After-drying at power levels ranging from 1.5 to 6.0 kW heated the ceramic as expected with the body temperature reaching an equilibrium between injected microwave energy and the surface dissipation effects of radiation and convection. Bowls were typically dried to below ambient moisture conditions. A "dried bowl" is defined as one which neither gained nor lost weight as it cooled overnight; a "super-dried bowl" is one which showed unmistakable weight gain during cooling. Specific results in that regard are dependent upon ambient humidity conditions. Humidity measurements were not made.

Tests were performed using both microwave frequencies allocated for industrial purposes, 915 MHz and 2450 MHz. No significant differences were noted between the ovens in terms of efficiency or allowable rate of drying. Because of considerations of access to the 2450 MHz oven (i.e., a small door requiring much manipulation of parts in the oven), tests attempting the drying of two bowls at once were run only in the 915 MHz oven.

Process parameters presented are those associated with drying the toilet bowl, the gating item in terms of process time and energy levels. The basic drying process requires about 4 kW hrs. of microwave energy/-bowl. The time required in hours is then 4/divided by the power level in kW. The data shows that under the specific test conditions, at power level of three (3) kilowatts, the bodies burst. At two (2) kilowatts, cracking or bursts are likely. At one (1) kilowatt, parts can be predictably produced under ambient conditions without much attention to air flow. At a level of 1.5 kilowatts, second order effects begin to appear. Air flow velocities and distributions become significant. Proper management of air, at ambient humidity, will allow predictable fault-free drying. Too rapid air flow or badly distributed air velocities will cause differential drying on different surfaces of the product and a high probability of stress-related cracking as the body shrinks. Attention to this detail cuts drying time from four (4) hours to about two and one-half (2.5) hours using ambient air as the environment. Naturally, changing test conditions, i.e., decreasing the rate of microwave energy addition, the moisture content of the "green body", and the like, may change the results noted above.

After the drying step is complete at the drying station 35, a conveyor 36 transfers the dried ware to glazing and firing stations (not shown in the drawing), for final treatment in a kiln, or the like.

The processes described in connection with the invention are subject to any number of modifications. Typically, and as mentioned in connection with the mold-drying station 23, through a suitable arrangement of conveyors and production timing, it is possible to carry out much of the process with one or two microwave heating devices, rather than install a separate microwave apparatus at each station which requires heat application. It is also clear that microwave technique can be used to dry new manufactured plaster-of-paris molds.

What is claimed:

1. A method for producing ceramic ware from slip that contains water, comprising the steps of:

a. pouring the slip into an optimally moistened porous mold having a predetermined overall weight;

b. forming a green body within the mold by i. a single application of microwave energy to the combination of the mold and slip to cake the slip at the mold surface and ii. thereafter setting up the cake in ambient air without the application microwave energy;

c. decanting the excess slip from the mold;

d. removing the mold from the green body;

e. weighing the mold; and f. adding moisture to the mold to obtain said predetermined overall weight whereby the mold is optimally moistened for reuse.

2. The method according to claim 1, further comprising the step of applying microwave energy to the combination of cake and mold after decanting the excess slip and before removing the mold.

3. The method according to claim 1 or claim 2, further comprising the step of applying microwave energy to the green body after removal from the mold.

* * * * *